US005206976A

United States Patent [19]

Aihara et al.

[11] Patent Number: 5,206,976

[45] Date of Patent: May 4, 1993

[54] AUTOMATIC SHEDDING MECHANISM

[75] Inventors: Takatsugu Aihara; Soichiro Hisano, both of Kiryu, Japan

[73] Assignee: Suzuki Warper Ltd., Kiryu, Japan

[21] Appl. No.: 651,270

[22] PCT Filed: Mar. 27, 1990

[86] PCT No.: PCT/JP90/00406

§ 371 Date: Apr. 17, 1991

§ 102(e) Date: Apr. 17, 1991

[87] PCT Pub. No.: WO91/14812

PCT Pub. Date: Oct. 3, 1991

[51] Int. Cl.[5] ..... D02H 9/00; D02M 13/34

[52] U.S. Cl. ..... 28/198; 28/191

[58] Field of Search ..... 28/198, 199, 190, 191, 28/196

[56] References Cited

U.S. PATENT DOCUMENTS

| | | | |
|---|---|---|---|
| 4,683,625 | 8/1987 | Baltzer | 28/198 X |
| 4,765,041 | 8/1988 | Baltzer | 28/198 X |
| 4,831,695 | 5/1989 | Baltzer | 28/191 |
| 5,027,485 | 7/1991 | Hager et al. | 28/194 |

FOREIGN PATENT DOCUMENTS

| | | |
|---|---|---|
| 2065984 | 8/1971 | France . |
| 2058164A | 4/1981 | United Kingdom . |
| 2137240A | 10/1984 | United Kingdom . |
| 2210642A | 6/1989 | United Kingdom . |

*Primary Examiner*—Clifford D. Crowder
*Assistant Examiner*—Bibhu Mohanty
*Attorney, Agent, or Firm*—Nikaido, Marmelstein, Murray & Oram

[57] ABSTRACT

With the automatic shedding mechanism according to this invention, the warping conditions are inputted by using the program setting unit 151. When it arrives at the predetermined position, the warping drum stops rotating. The closed reed 38 is operated to from lease, into which the lease rods 88 enter so as to maintain the lease and move upward to keep the lease. Next, the lease tape driving mechanism 94 is operated to have its movable unit 98 advance, so that the lease tapes T will be let off onto the warping drum 12 to the predetermined amount. Then the lease tapes go between the lease to maintain them. The above operation will be repeated for every band for the number of times according to the total number of the warping yarns and warping width. Therefore the shedding procedure will be continuously performed without cutting the warping yarns for each band. After the warping procedure, the lease cords are passed through the holes on the heddle hooks at the leading ends of the lease tapes. Then the lease tapes are retreated, thereby causing the lease cords to be inserted between the lease.

6 Claims, 17 Drawing Sheets

AUTOMATIC SHEDDING MECHANISM

BACKGROUND OF THE INVENTION

1. Field of the Invention

This invention relates to an automatic shedding mechanism in which the shedding operation in a warping machine is automated, and an electronically controlled sectional warping machine employing the automatic shedding mechanism.

2. Description of the Related Art

With a conventional warping machine, the shedding operation has been carried out by manually moving a closed reed up and down, keeping warp yarns apart with lease rods to form lease, and passing lease cords through the lease. Since the shedding operation is very complicated and requires the operators' dexterity, it has been very difficult to automate the shedding operation. An example of an automatic warping machine is exemplified in the Japanese Patent Laid-Open Publication No. 118640/1989.

With the cited warping machine, the lease rods for passing lease cords into the lease are held by a gripper and are moved to a certain extent by the gripper. Therefore the warping machine should include the gripper and means for driving the gripper, which makes the machine complicated in a controlling mechanism and in the overall structure. In addition, the operation speed of the machine is slow, and the machine becomes very expensive.

Therefore it is an object of this invention to completely automate the shedding operation under the electronic control by a computer. A second object of the invention is to provide an automatic shedding mechanism and an electronically controlled sectional warping machine, which are simple in the overall structure, are inexpensive, and have a fast operation speed.

SUMMARY OF THE INVENTION

According to the first aspect of this invention, there is provided an automatic shedding mechanism, which comprises a warping drum which is rotatably disposed on a bearing via a drum shaft and is rotated by driving means including an electronically controlled motor, a plurality of lease tapes which are conducted onto the surface of said warping drum via a lease tape guide and are moved between lease formed by warping yarns, a reel which is disposed on a side of said warping drum and includes means for reeling said lease tapes, and a movable unit which is moved back and forth by said electronically controlled driving means so as to come into contact with and out of contact from said lease tapes and said means.

Six lease tapes are used for the cut shedding down, first and second front shedding, cut shedding up, and first and second back shedding. The number of lease tapes depends upon the number of lease to be formed, and may be equal to, less or more than six.

The lease tapes are preferably flexible in the lengthwise direction, are difficult to bend in the widthwise direction, and are steel tapes having a thickness of 0.3 mm or less and a width of 50 mm or less. The lease tapes may be thin synthetic resin tapes. Since the lease tapes are flexible, they pass through the lease tape guide according to the shape of the lease tape guide. Further the lease tapes are difficult to bend in the widthwise direction, and do not bend laterally after passing through the lease tape guide. The lease tapes are so light in weight that they are not affected by their own centrifugal force when they are rotated together with the warping drum. Therefore the warping drum can be rotated at a high speed.

The lease tapes are let off by means of the frictional forces generated by the rotation of the lease tape feeding motor between the lease tapes and the rubber roll. The lease tapes may be let off by a rubber belt in place of the rubber roll.

The amount of the lease tapes to be let off is determined by the number of pulses applied to the electronically controlled motor, and can be also determined by detecting the position of the leading ends of the lease tapes by means of a sensor or the like.

The lease tapes have at their ends hooks with holes for hooking the lease cords. When the lease tapes having the lease cords hooked on their holes are moved backward, the lease cords are easily inserted into the lease.

According to the second aspect of this invention, there is provided an electronically controlled sectional warping machine, in which a warping process is performed by dividing all the warping yarns for fabric into a certain number of bands, by passing warping yarns led from a creel for one band through a closed reed and a space deciding reed, by reeling warping yarns around a warping drum at the necessary density and to the necessary length, so that warping is done for the desired number of warping yarns and to the desired warping width. The electronically controlled sectional warping machine comprises a warping drum which stops rotating when it reaches the predetermined position, a closed reed for forming lease by dividing warping yarns from said creel into upper and lower yarns, a space deciding reed moved back and forth by said driving mechanism so as to decide the space of the warping yarns, lease rods going into lease formed by said closed reed and moving upward so as to keep the lease apart widely, a plurality of lease tapes which are let off to the surface of said warping drum via a lease tape guide so as to maintain the lease while going through the lease, a reel which is disposed on a side of said warping drum so as to take in said lease tapes and includes means for reeling said lease tapes, and a movable unit which is moved back and forth by the electronically controlled motor so as to let off and rewind said lease tapes.

DETAILED DESCRIPTION

An embodiment of the invention will be described with reference to the accompanying drawings.

Figure 1:
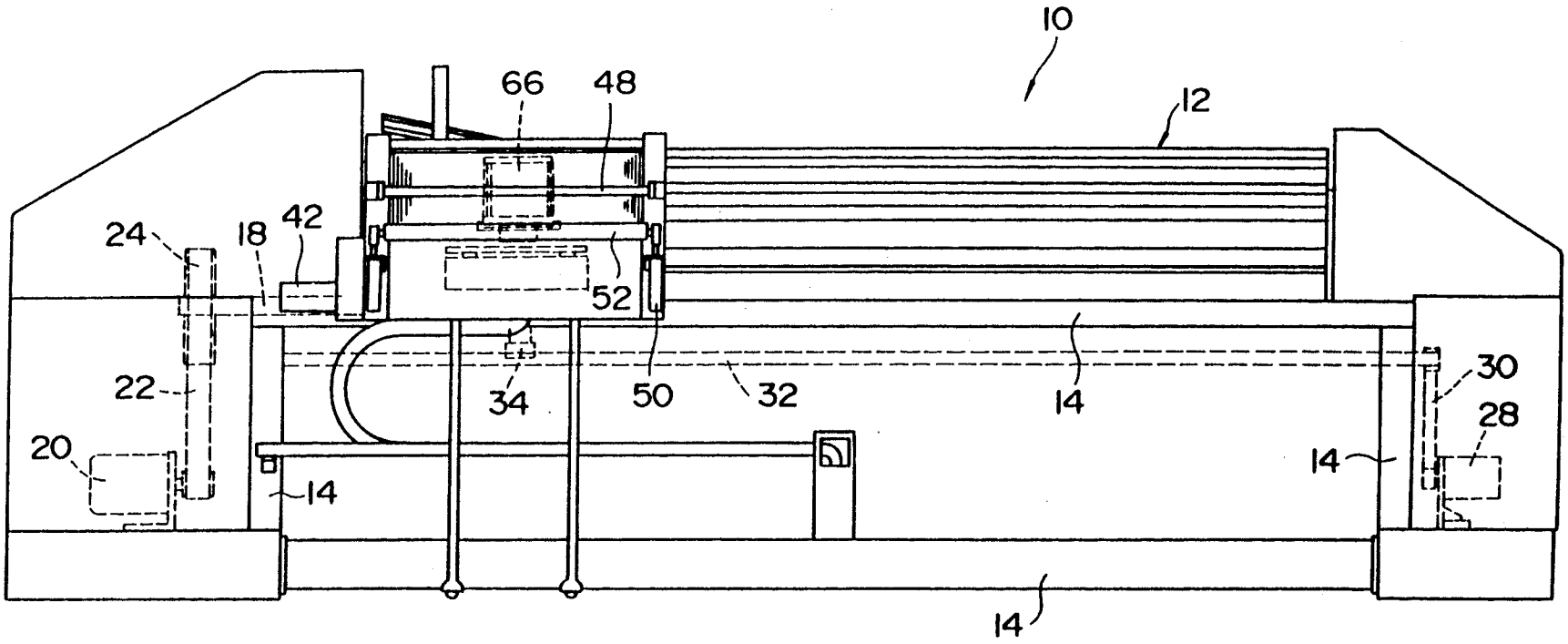
FIG. 1 is a front elevational view of a sectional warping machine.

As shown in FIG. 1, a sectional warping machine 10 includes a warping drum 12. The warping drum 12 is supported on a drum shaft 18. The drum shaft 18 is rotatably disposed in a bearing 16, which is disposed on a base frame 14. The drum shaft 18 is rotated by an inverter motor 20 via a transmission member 22 such as a belt, and a belt pulley 24. These members drive the warping drum 12. A reed space setting member 26 is driven by a motor 28 via a belt-shaped transmission member 30 and a screw shaft 32, and is reciprocated in the axial direction of the warping drum 12 by means of a screw nut 34 engaged with the screw shaft 32.

Figure 2:
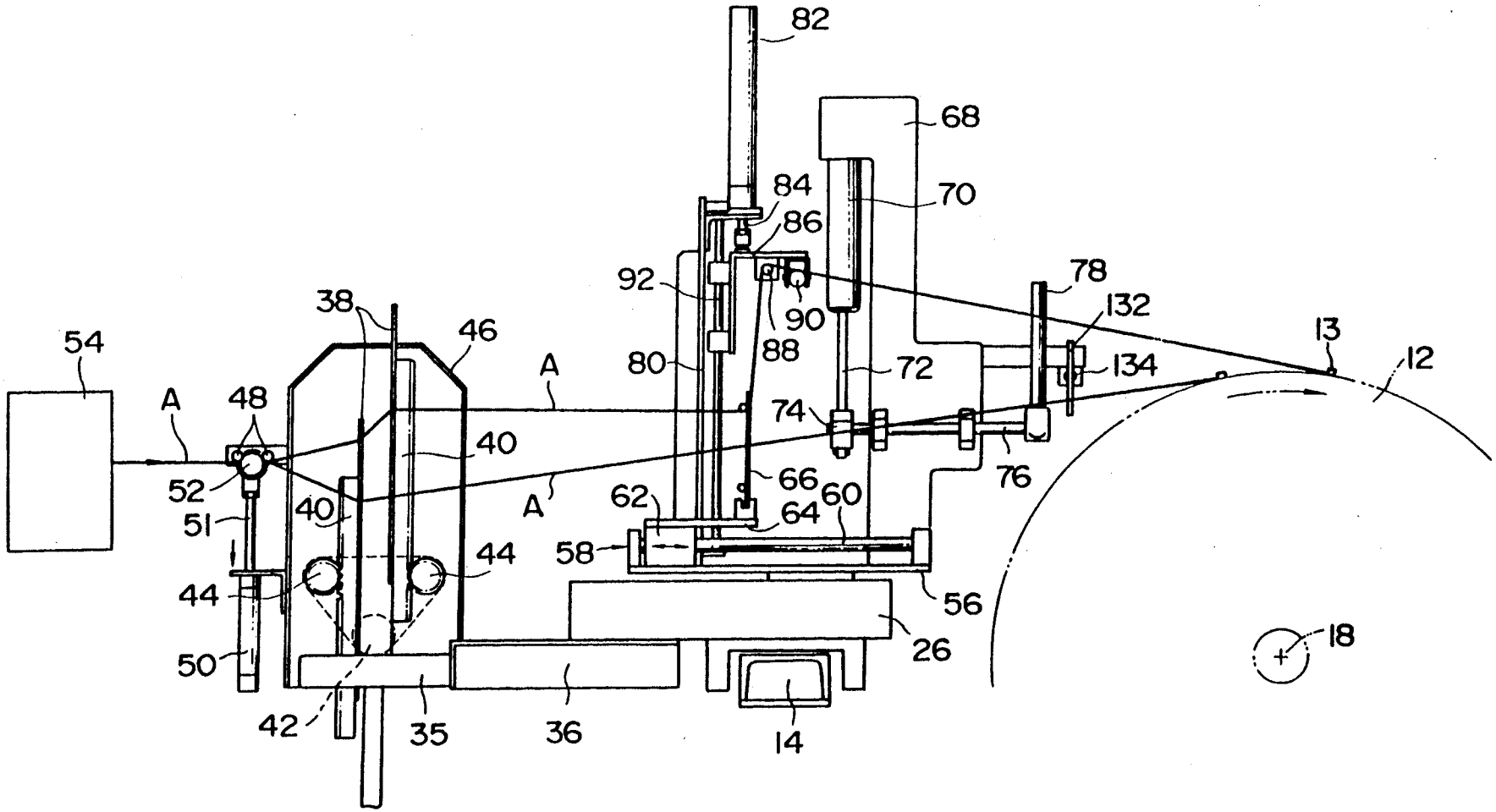
FIG. 2 is a side elevational view showing a shed in an enlarged scale.

In FIG. 2, the reference numeral 35 stands for a closed reed base 35 which is connected to the reed space setting member 26 via a joint member 36 so that closed reeds 38 on the closed reed base 35 can alternately move up and down. The closed reeds are fixedly disposed on racks 40, which are moved up and down by gears 44 following the rotation of a motor 42 having a brake, thereby causing the closed reeds 38 to move vertically. On both sides of the closed reed base 35 are vertically disposed base frames 46, which include yarn pushing shafts 48 disposed horizontally and in parallel each other. The base frames 46 also include a pair of air cylinders 50. On the end of a piston rod 51 of the air cylinder, there is disposed a rubber roll 52 in parallel with the yarn pushing shafts 48, so that the rubber roll 52 moves up and down so as to come into contact with and out of contact with the yarn pushing shafts 48. Warping yarns A of different colors, which are fed from a creel 54 including a plurality of bobbins, are tensioned when they pass between the rubber roll 52 and the yarn pushing shafts 48.

A rodless cylinder 58 is disposed on a base plate 56 which is above the reed space setting member 26. The rodless cylinder 58 comprises a guide rod 62 and a cylindrical movable member 62. A space deciding reed 66 is vertically disposed on the moving member 62 through a mounting plate 64. The base plate 56 includes a vertically extending member 68 on its side facing the drum 12. At its upper end, the member 68 includes an air cylinder 70 extending downwardly. The air cylinder 70 has a piston rod 72, to end of which a rotary shaft 76 is connected via a converter 74. A guide roller 78 is disposed at the end of the rotary shaft 76. The rotary shaft 76 includes a guide roller 78 at its end. Following the operation of the air cylinder 70, the guide roller 78 causes the rotary shaft 76 to rotate via the converter 74. Then the guide roller 78 rotates approximately 90 degrees from the vertical position to the horizontal position, so that the warping yarns A are pressed toward the warping drum 12 and are neatly wound around the warping drum 12.

An air cylinder 82 is disposed above the base plate 56 via a plate 80, i.e., on the side opposite to the vertically extending member 68. A piston rod 84 at one end of the air cylinder 82 includes lease rods 88 and an air cylinder 90 disposed on a bracket 86. The air cylinder 90 causes the lease rods 88 to move back and forth in parallel with a drum shaft 18. In addition, the lease rods 88 move vertically along the guide rod 92 in response to the operation of the air cylinder 82, so that lease formed by the closed reeds are kept in position.

On the other side of the warping drum 12, there is disposed a lease tape driving mechanism 94. The lease tape driving mechanism 94 comprises a stationary unit 96, which contains lease tapes T and is fixedly disposed on the side of the warping drum, and a movable unit 98 which lets off the lease tapes T to a certain extent and is movable to and from the stationary unit 96.

The stationary unit 96 comprises a reel 100 for winding the lease tapes T, a sliding plate 102 for receiving the lease tapes T, and a lease tape guide for guiding the lease tapes T to the warping drum 12 so as to make the lease tapes T parallel with the drum shaft 18. The reel 100 includes a gear 106 for rewinding the lease tapes and a spring 108 serving as a brake.

The lease tapes T are preferably flexible in the lengthwise direction but are rigid in the widthwise direction. For example, a steel tape having a thickness of 0.3 mm or less and a width of 50 mm or less is preferable as the lease tapes T. The lease tapes T are taken in the reel 100, and are passed through the sliding plate 102 while being bent according to the shape of the lease tape guide 104, and are led to the surface of the warping drum 12. At the leading end, each of the lease tapes T has a hook 112 having a hole 100 for passing the lease cord. As described later, six lease tapes T are caused to appear and disappear on the surface of the warping drum 12 from the side of the drum 12. These six lease tapes are used for the cut shedding down, first front shedding, second front shedding, cut shedding up, first back shedding, and second back shedding.

The movable unit 98 is disposed on the base frame 14. Reference numeral 114 represents an orbit along which a guide 116 moves. The guide 116 is disposed on the base frame 14, and includes a tape driving unit and an air cylinder 122 for moving the tape driving unit. The tape driving unit comprises two motors 118 and 120 for winding and feeding the lease tapes.

The lease tapes T are let off by two rubber rollers 126 which are connected to the electronically controlled tape feeding motor 120 via the belt 124. The lease tapes T may be fed by another method. For example, the lease tapes T having holes made at predetermined positions may be fed in cooperation with a sprocket or gear instead of the rubber rollers 126. The lease tapes T are rewound by operating the electronically controlled tape rewinding motor 118 together with a plurality of gears 130 which are in engagement with the belt 128 and a gear 106 of the reel 100.

Reference numeral 132 stands for a yarn pushing member, which is disposed on an air cylinder 134 on the vertically extending unit 68 of the guide roller 78. The yarn pushing member 132 is movable in the axial direction of the warping drum 12.

The operation of the automatic shedding mechanism will be described hereinafter.

Figure 4A:
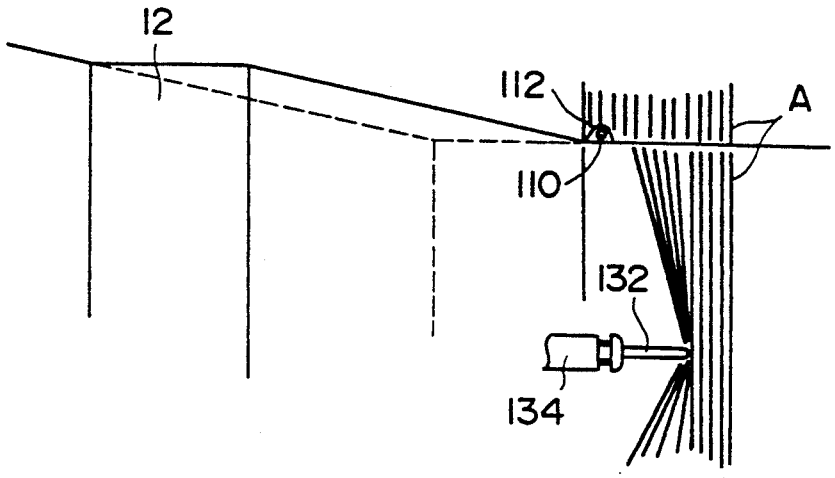
FIGS. 4A and 4B illustrate how under warping yarns are pushed laterally by means of a yarn pushing member.
Figure 4B:
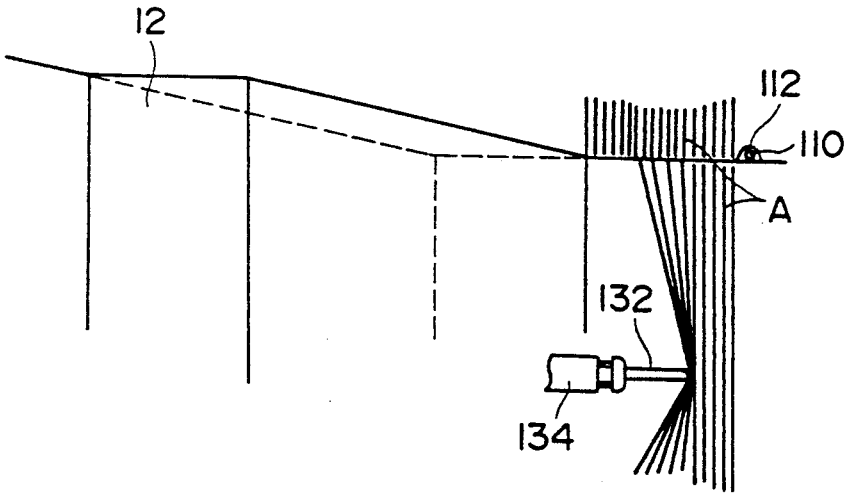

First the rodless cylinder 58 is operated to let the space deciding reed 66 retreat toward the creel 54. The motor 42 having a brake is rotated so as to move the closed reeds 38 alternately up and down to keep the warping yarns A apart. Then the air cylinder 82 is operated to move the lease rods 88 downward. The air cylinder 90 is operated to cause the lease rods 88 to go into the warping yarns A which are kept apart. At the same time, the air cylinder 70 is operated to keep the guide roller 78 at right angles with the drum shaft 18. The air cylinder 82 is operated to move the lease rods 88 upward and to keep the warping yarns A further apart as illustrated in FIG. 2. Then the air cylinder 134 is operated to cause the yarn pushing member 132 to advance in the lengthwise direction of the drum shaft 18. The yarn pushing member 132 holds under-yarns $A_1$ of the warping yarns A as shown in FIGS. 4*a* and 4*b*. After this, the air cylinder 50 is operated so as to move the rubber roll 52 upwards. The rubber roll 52 and the yarn pushing shaft 48 sandwich the warping yarns A to make them tensioned.

Figure 3:
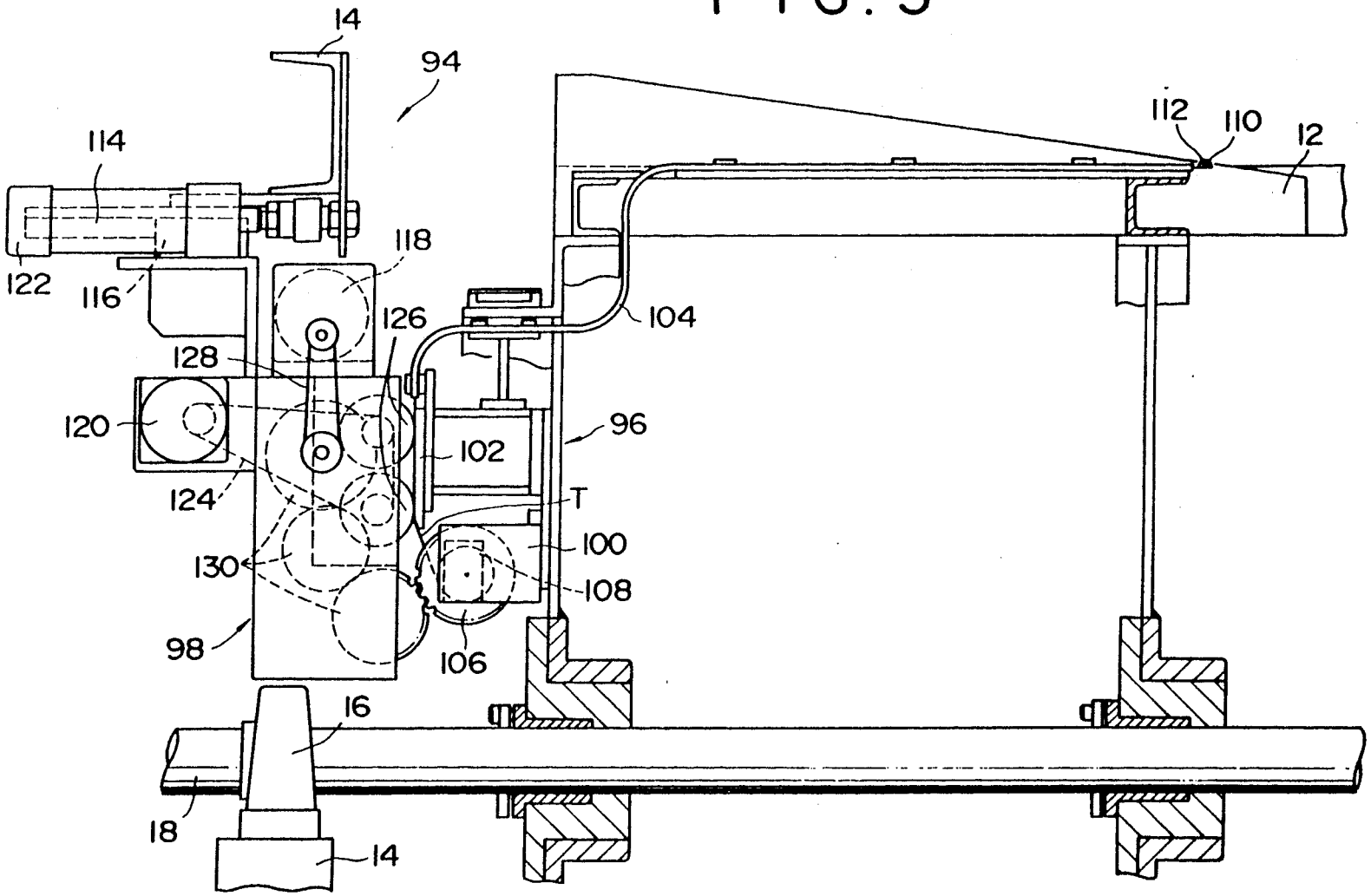
FIG. 3 is a partially enlarged sectional view showing the relationship of a warping drum and a shedding mechanism.
Figure 5:
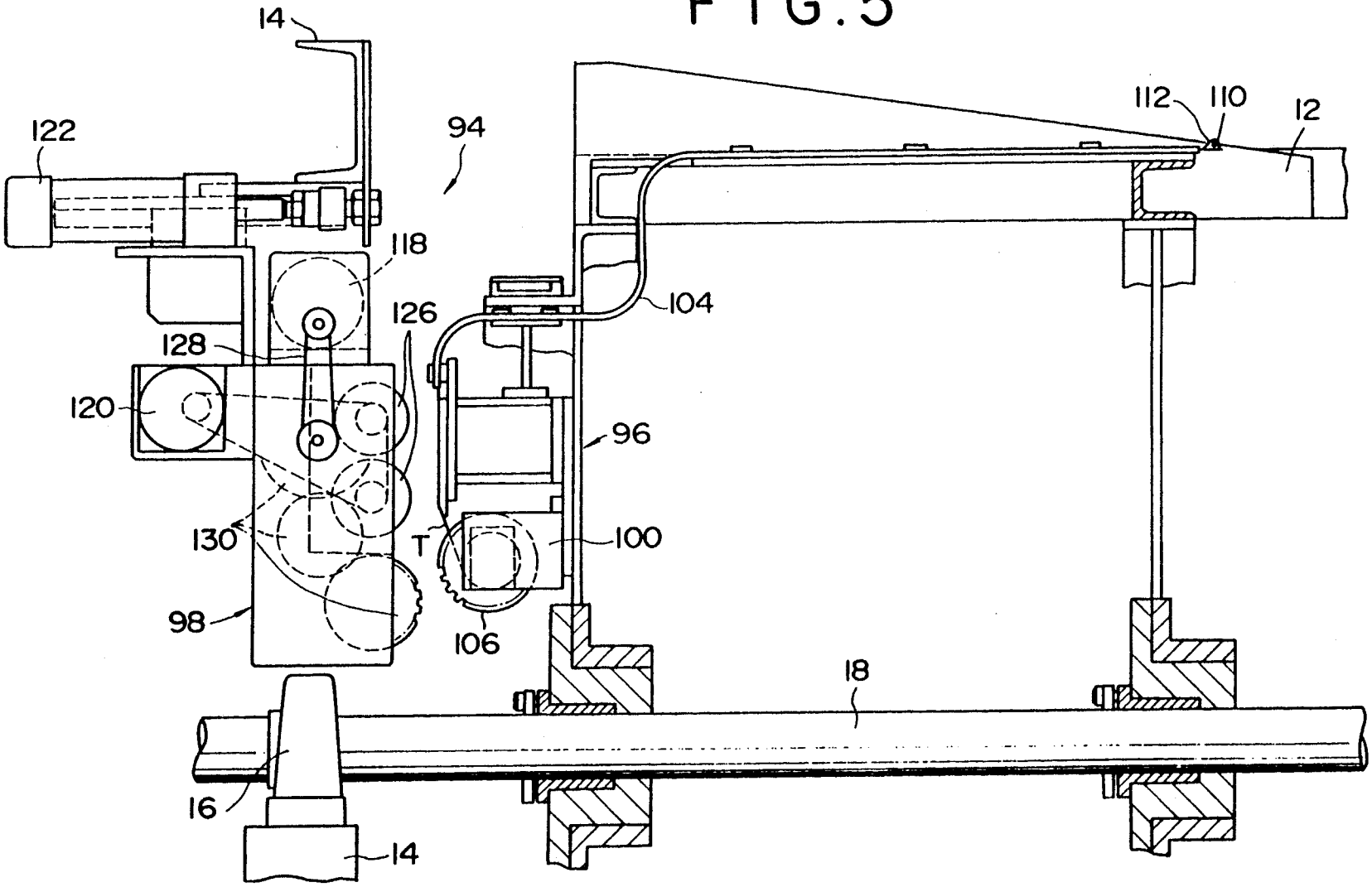
FIG. 5 is a partly enlarged sectional view showing the operating state of lease a tape driving mechanism of FIG. 3.
Figure 6:
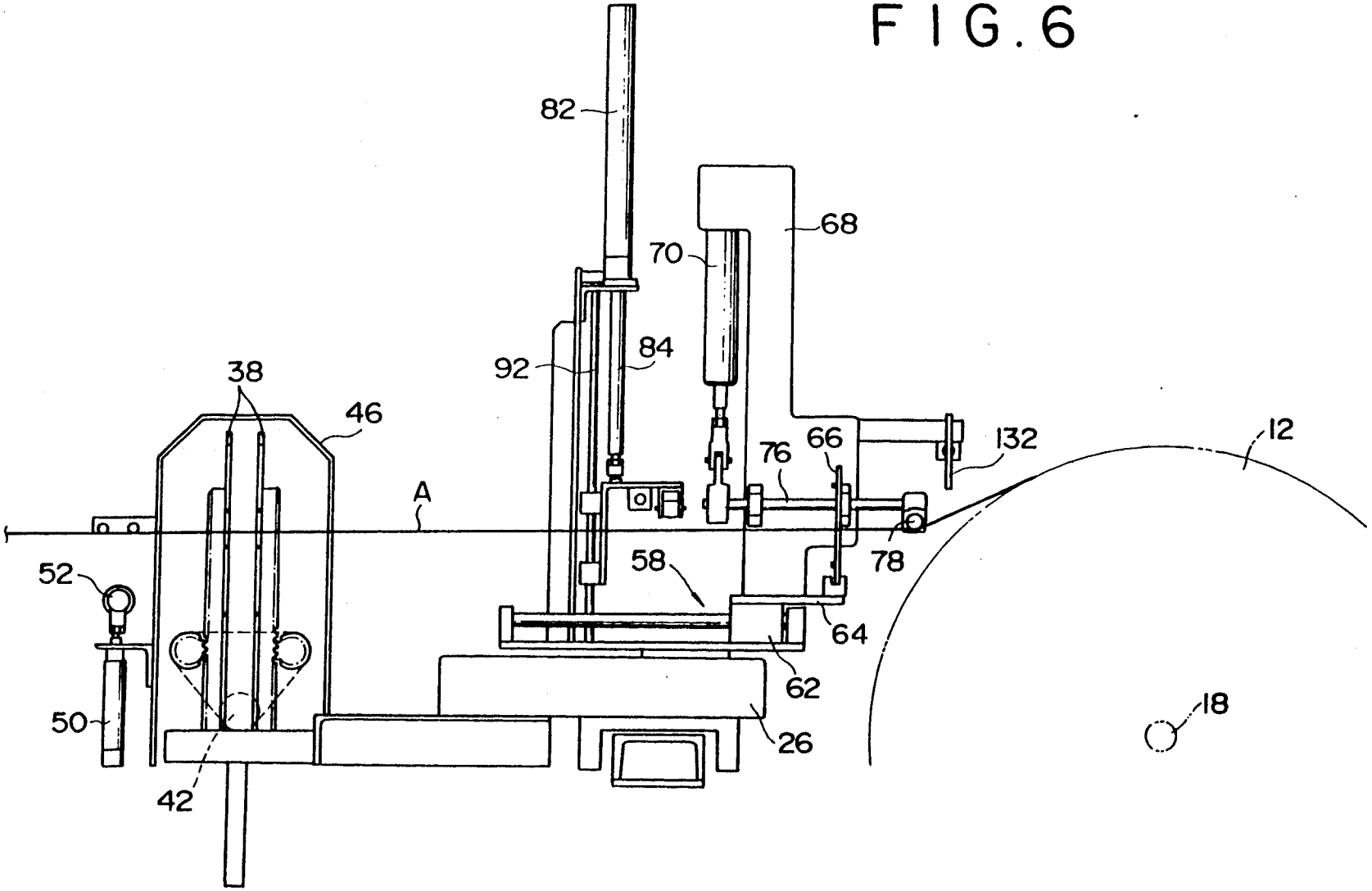
FIG. 6 is a side elevational view showing the state in which a space deciding reed is advanced for the warping operation.

An AC servomotor 20 operates the warping drum 12 and stops it at the lease crossing position. Operation of the air cylinder 122 moves the movable unit 98 of the lease tape feeding mechanism 94 from the position shown in FIG. 5, and makes the rubber roller 126 come into contact with the lease tapes T as shown in FIG. 3. Therefore the tape feeding motor 120 is driven to feed the lease tapes T to the predetermined extent. An electromagnetic valve of the air cylinder 134 is switched to return the yarn pushing member 132 to the original position, makes the rubber roll 52 descend, detaches the movable unit 98 from the stationary unit 96, lowers the lease rods 88 while rotating the warping drum 12, and removes the lease rods 88 from the lease. Then the closed reeds 38 are returned to the original position. In addition, the guide roller 78 is made to return to the original position.

Figure 7:
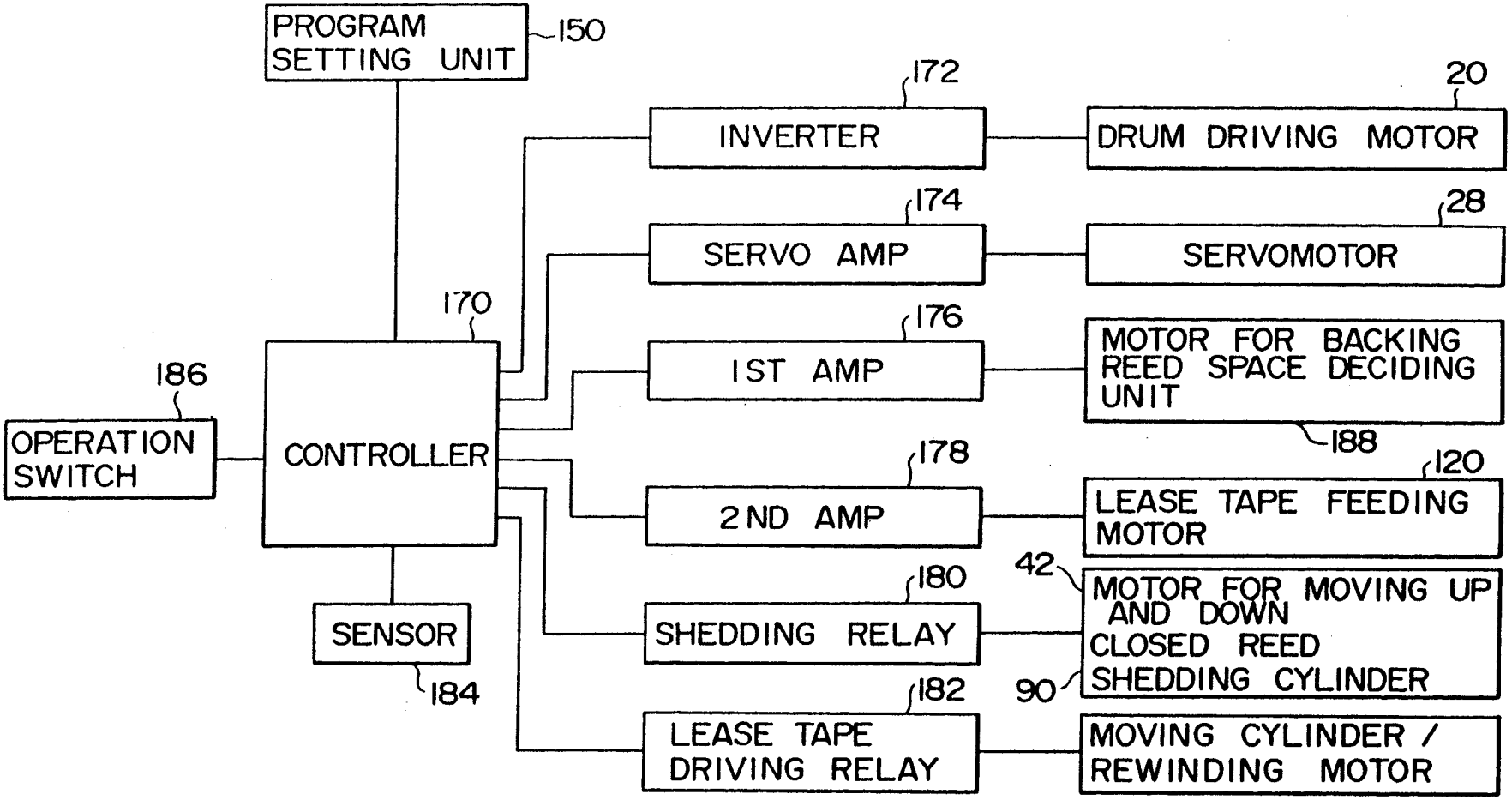
FIG. 7 is a block diagram showing a control unit of an electronically controlled sectional warping machine.
Figure 8:
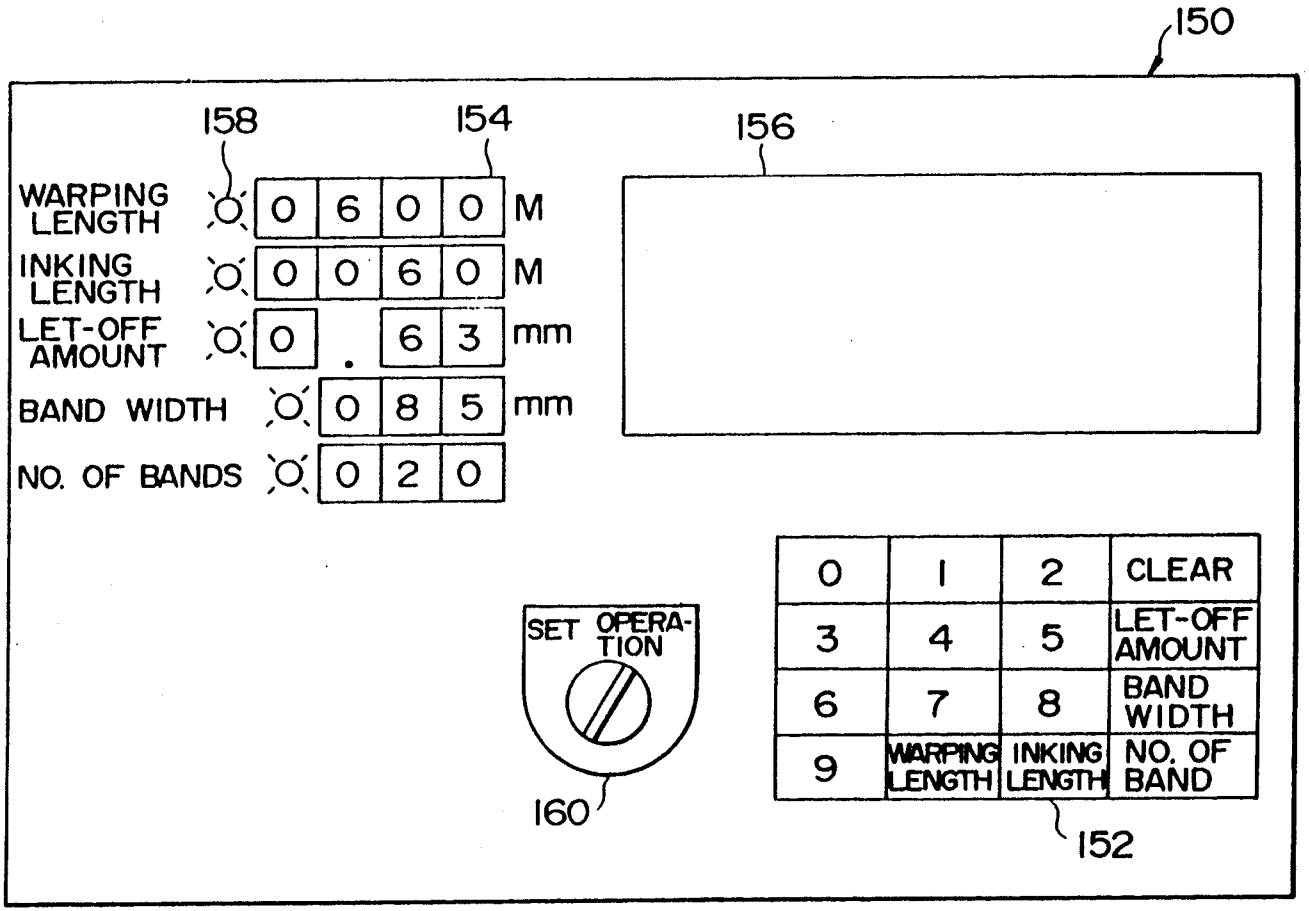
FIG. 8 is a front elevational view of a program setting unit.

FIG. 7 is a block diagram showing the control unit of the electronically controlled automatic sectional warping machine. FIG. 8 shows a program setting unit 150. The program setting unit 150 comprises a group of input keys 152, an LED display 156, LED lamps 158, and a selector 160. The input keys 152 are used to input the warping data such as warping length, inking length, amount of the warping yarns to be fed per rotation of the warping drum, band width and number of bands. The LED display 154 indicates the inputted data, and actual values in use. The LED lamps are for confirming the inputted data. The LED display 156 shows the warping procedure, operation in progress, reasons for interrupted operation, and so forth.

The selector 160 is first to set to the set position so as to input the warping data such as (a) warping length: 600 m, (b) inking length: 60 m, (c) amount to be fed: 0.63 mm, (d) 85 mm, and (e) 20 times. Then the clear key in the input key group 152 is depressed to erase the previous data. Next, a desired one of the keys 152 is pushed.

When the warping length key is pushed, the LED lamp 158 corresponding to the warping length is lit to indicate the inputting operation is feasible. When the numerical keys "6", "0" and "0" are pushed in succession, the LED display 154 indicates "0060". Thus the warping length is inputted. When the inking length key is pushed, the LED lamp 158 showing the inking length is lit in turn. Depression of the numerical keys "6", "0", the LED display 154 shows "0060", thereby causing the inking length data to be inputted. Then when the feed amount key is pushed, the LED lamp 158 showing the feed amount is lit in turn. Then the numerical keys "6", "3" are pushed sequentially, the LED display 154 indicates "0.63", so that the feed amount data are inputted. When the band width key is pushed, the LED lamp 158 showing the band width is lit in turn. Depression of the numerical keys "8", "5" causes the LED display 154 to show "085", so that the band width data can be inputted. When the number-of-bands key is depressed finally, the LED lamp 158 showing the number of bands is lit in turn. When the numerical keys "2", "0" are pushed, the LED display 154 shows "020". Thus the number of bands is inputted.

When the selector 160 is set to the operate position after inputting the data, the LED lamp goes out while the inputted data are indicated on the LED displays 154 as illustrated in FIG. 8. When the selector is set to the operate position, no further inputting operation will be possible. In addition, when the warping machine is started, the LED displays show the actual values of the warping length, inking length, and number of bands. The inputted data and actual values are stored in a unit operated by backup batteries.

A controller 170 shown in FIG. 7 controls the warping machine. For instance, the controller 170 controls, according the data inputted on the program setting unit 150, an inverter 172, a servo AMP 174, a first AMP 176, a second AMP 178, a shedding relay 180, a lease tape driving relay 182, and the display 156, all of which are connected to the controller 170.

The inverter 172 controls the turning on/off and rotation speed of the drum driving motor, and determines the lease crossing position by detecting the rotation angle by using a sensor 184.

The sensor 184 includes a sensor for detecting the original position of the drum, an encoder for reading the rotation angle of the drum, a sensor for detecting the original position of the reed space setting member 26, a left limit switch, and a right limit switch.

The servo AMP 174 rotates the AC servomotor 28, and controls the movement of the reed space setting member 26 such as the original point matching and band matching, and controls the amount to move the warping beam of a reeling machine.

The first AMP 176 controls a motor 188 for backing the base plate 56 (on the reed space setting member 26) according to the thickness of the thread layer on the warping drum 12. The second AMP 178 controls the feeding operation of the lease tape feeding motor 120.

The shedding relay 180 controls the air cylinders 50, 58, 70, 82 and 90, and the up/down shedding motor to regulate the lease of the warping yarns. The lease tape driving relay 182 controls the air cylinder 122 of the tape driving mechanism 94 and the tape rewinding motor 118 so as to insert the lease cords. Reference numeral 186 designates a switch.

Figure 9:
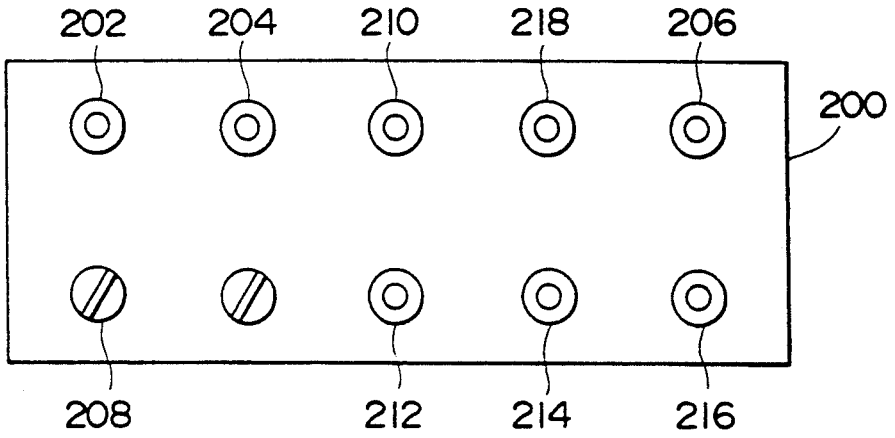
FIG. 9 is a front elevational view of an operation switch box.
Figure 10:
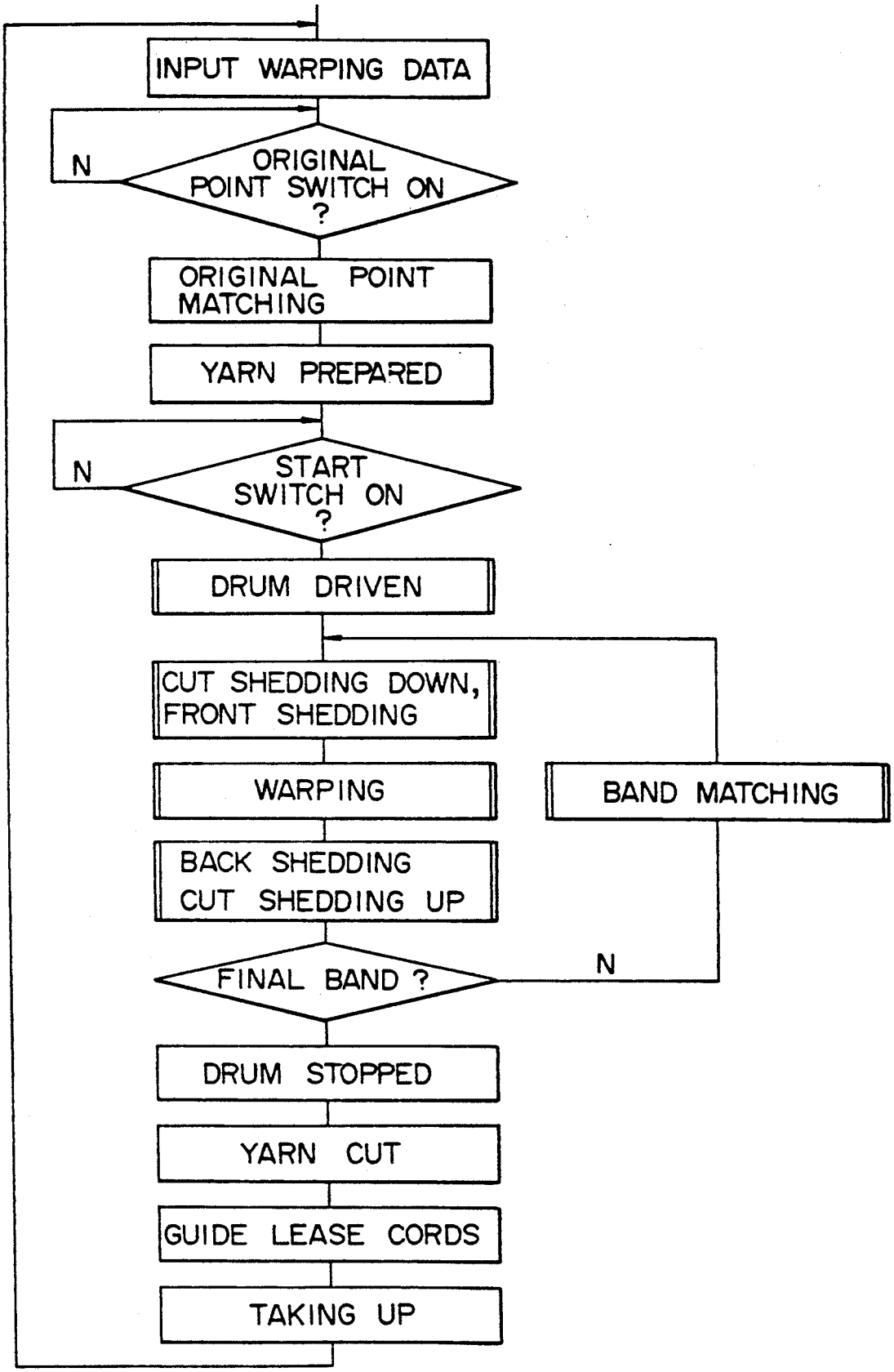
FIGS. 10*a* and 10*b* are flowcharts showing the operation sequence of the sectional warping machine.
Figure 11:
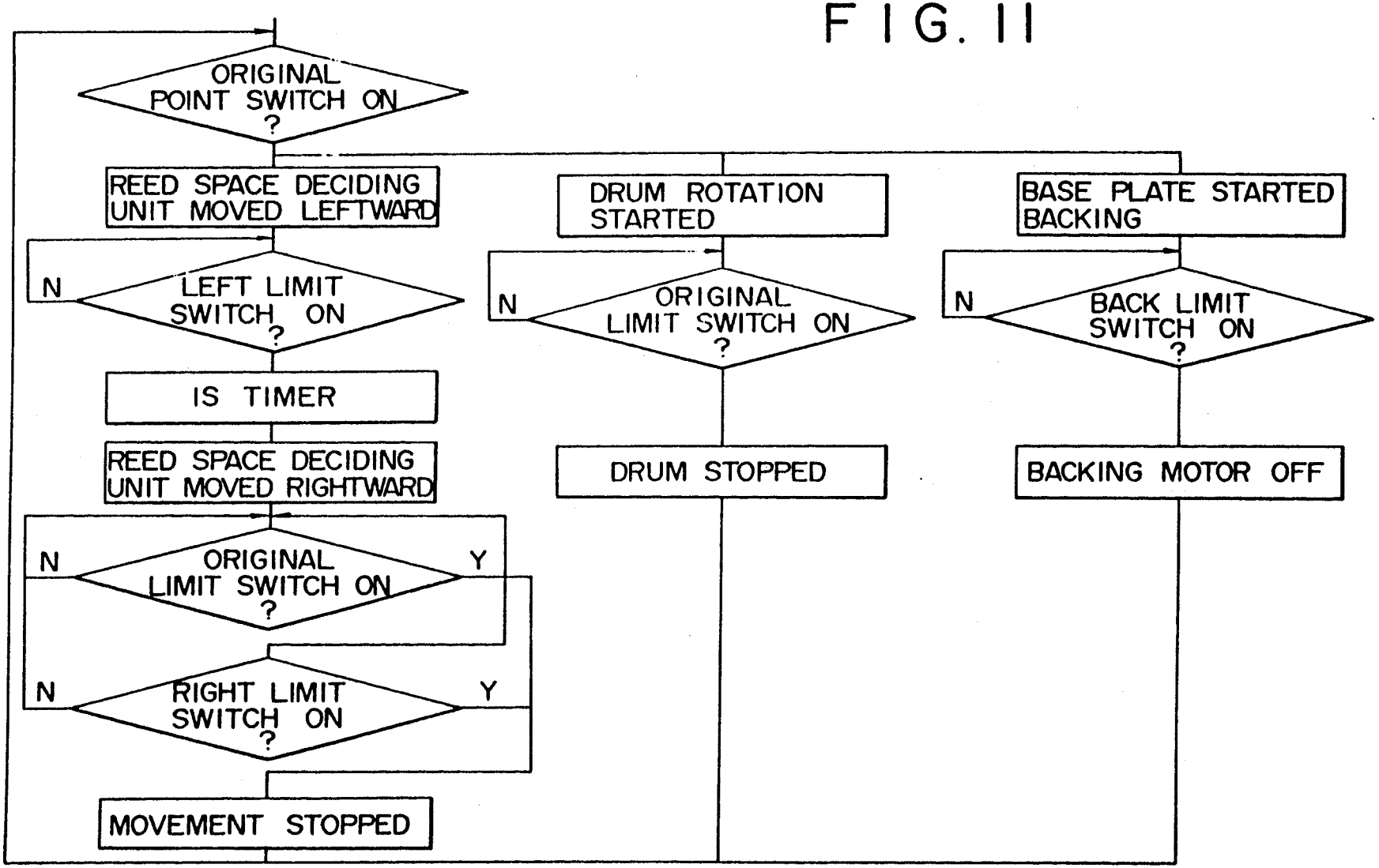
FIG. 11 is a detailed flowchart showing details of an original matching process.
Figure 12:
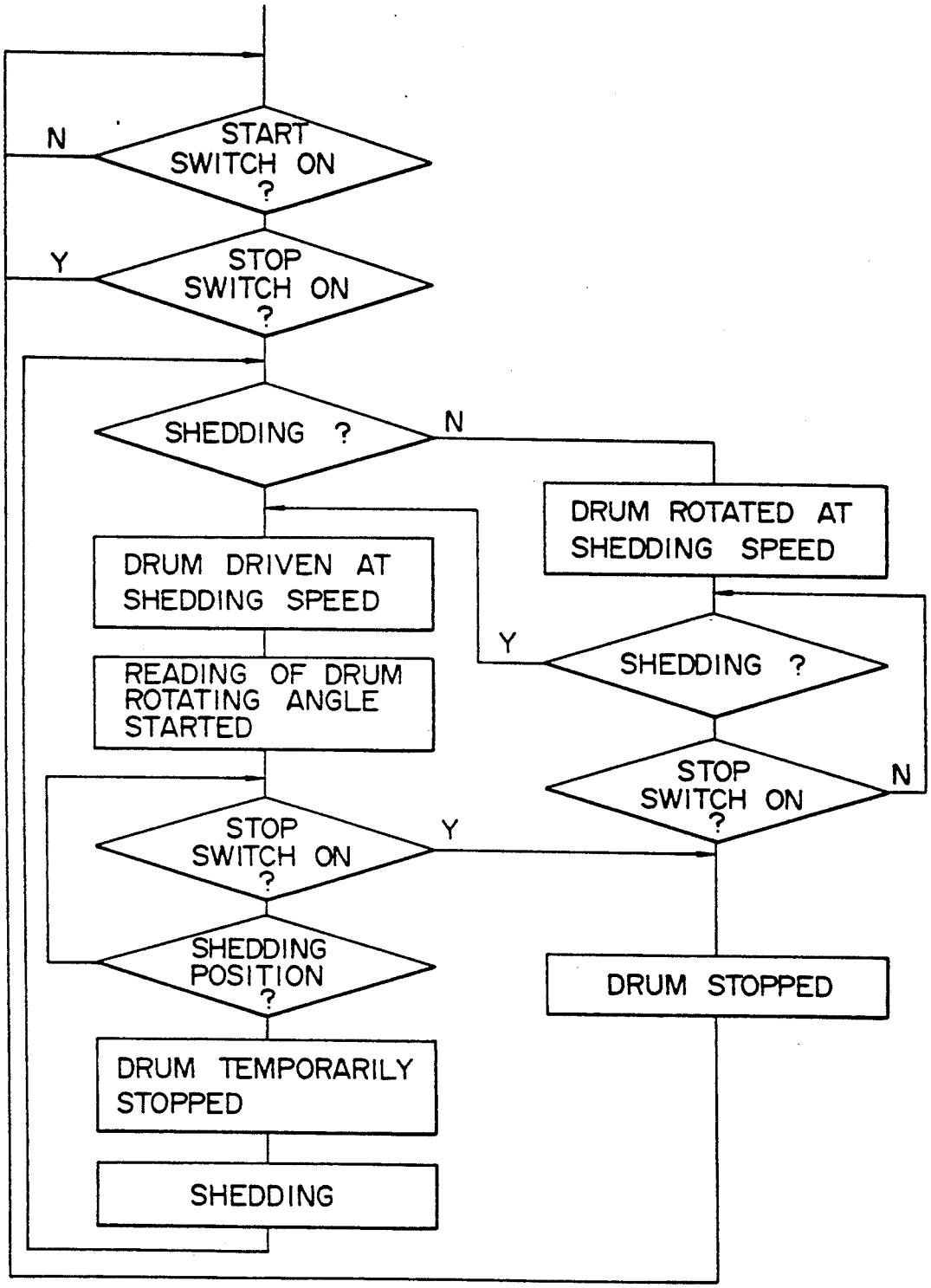
FIG. 12 is a flowchart showing a drum driving process and a warping process.
Figure 13A:
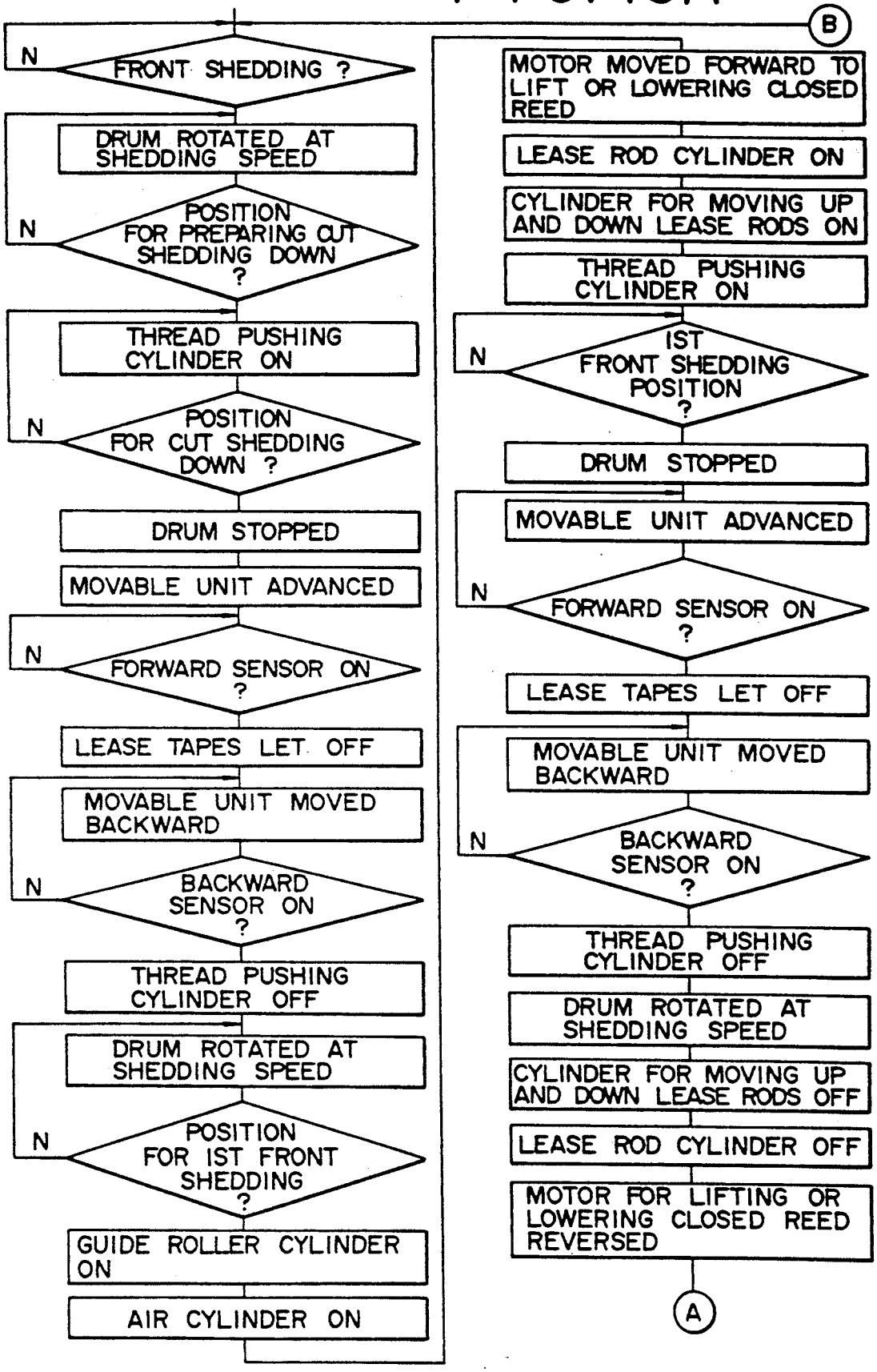
FIGS. 13*a* and 13*b* are flowcharts showing the procedures for the cut shedding down and the front shedding.
Figure 13B:
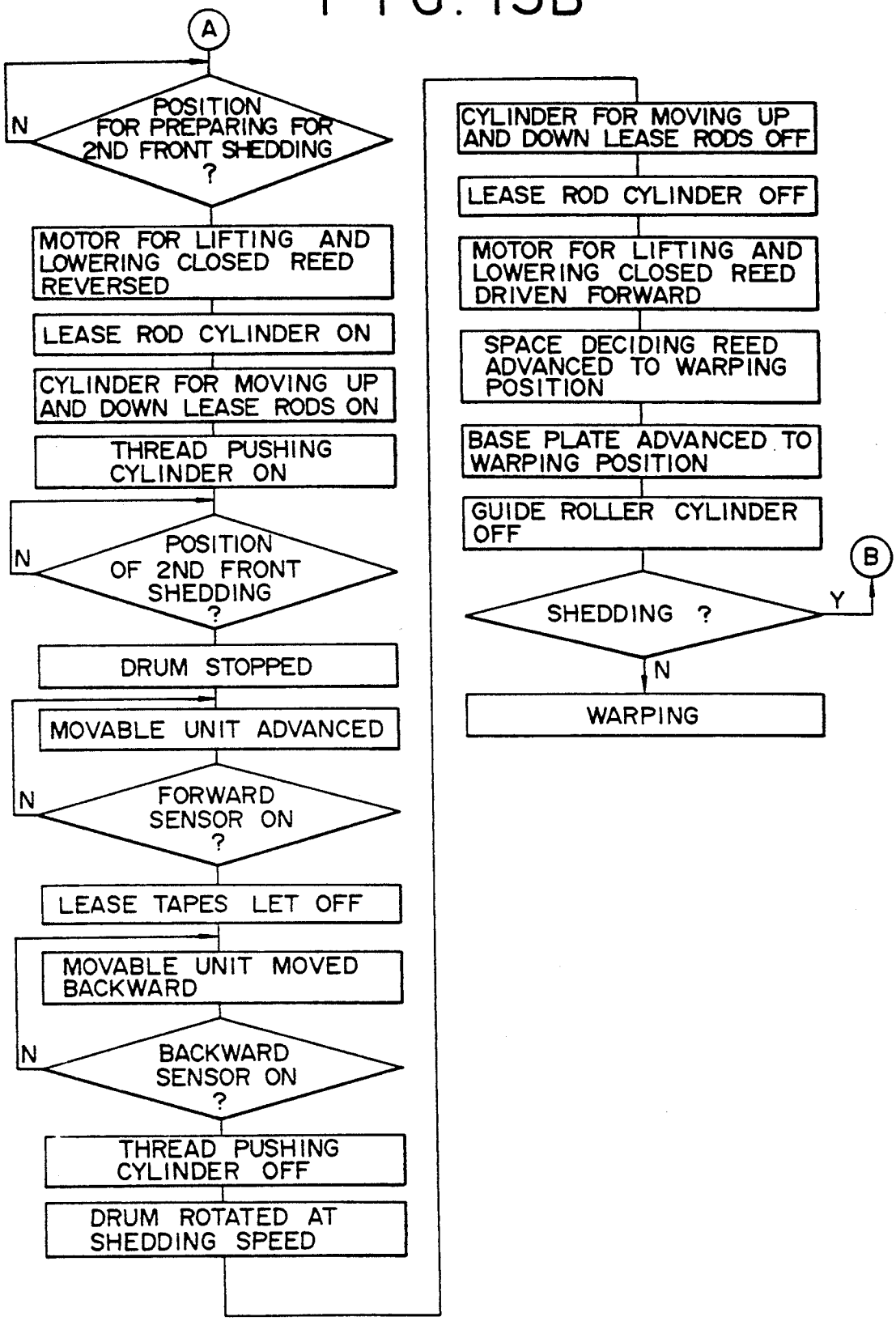
Figure 14A:
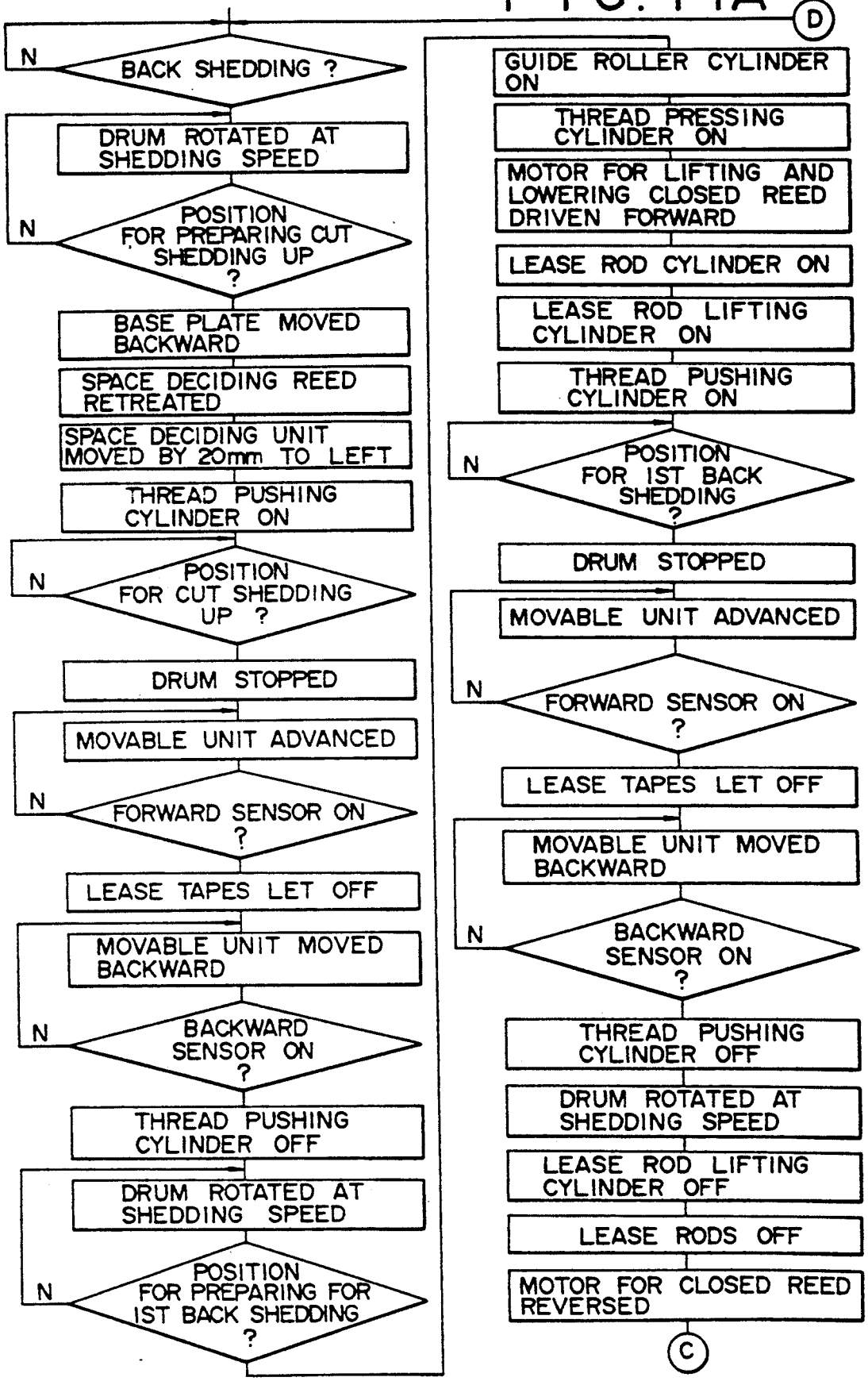
FIGS. 14A and 14B are flowcharts showing the procedures for the cut shedding up and the back shedding.
Figure 14B:
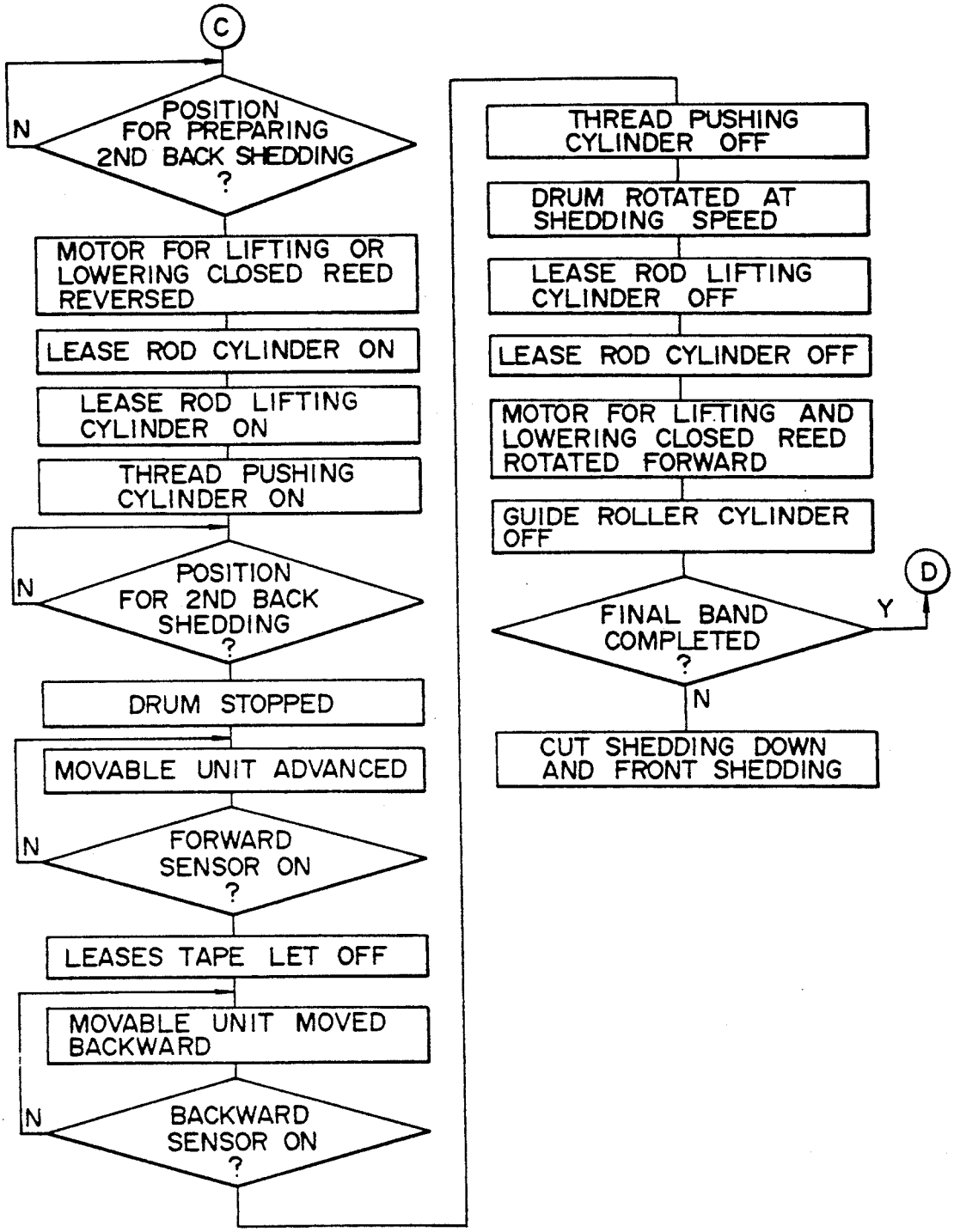
Figure 15:
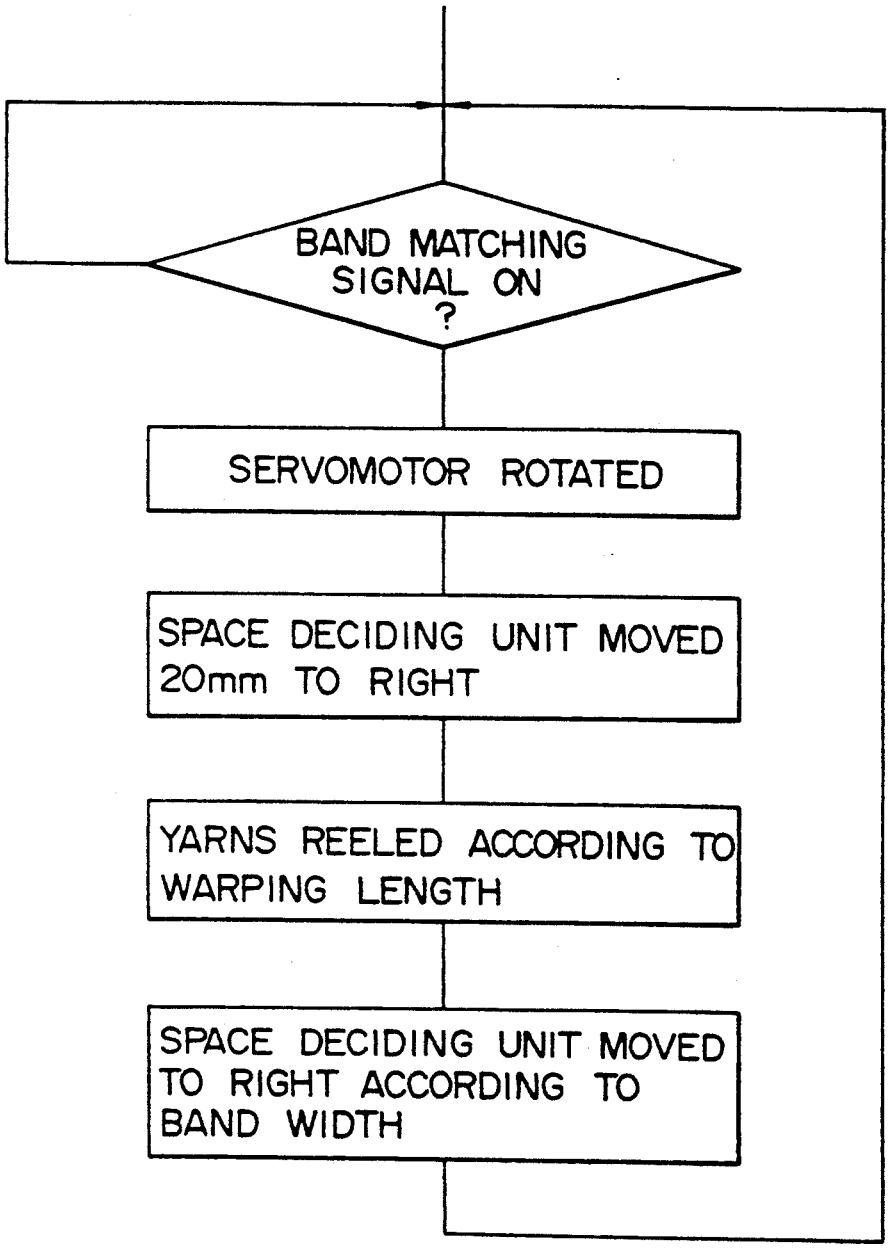
FIG. 15 is a flowchart for the band matching.

FIG. 9 is a schematic front elevation of a switch box 200. FIG. 10 is a flow chart showing the operation sequence of the overall warping machine. FIG. 11 is a flow chart for the original point matching. FIG. 12 is a flow chart showing the driving and warping operations of the warping drum. FIGS. 13*a* and 13*b* are flow charts showing the procedure for the cut shedding down and the front shedding. FIGS. 14*a* and 14*b* are flow charts showing the procedure for the cut shedding up and the back shedding. FIG. 15 is a flow chart for the band matching.

The respective operation procedures will be described with reference to FIGS. 9 to 15.

ORIGINAL POINT MATCHING

After inputting the warping conditions by using the program setting unit 150 as described previously, a switch 202 (for the original point matching) of the switch box 200 (shown in FIG. 9) is pushed so as to drive the inverter motor 20. Then the warping drum 12 is rotated, and is stopped at the original point. At the same time, the reed space setting member 26 is moved by the motor 28 to the left in FIG. 1. When it comes into contact with the left limit switch (not shown), the reed space setting member 26 stops temporarily, and then begins to move right, and is stopped and held by the original point matching switch 202. At the same time the base plate 56 on the reed space setting member 26 is moved back to the shedding position by the motor 188 for backing the reed space setting member. In addition, the rodless cylinder 58 for the space setting reed is operated to move the space setting reed 66 to the shedding position (to the left in FIG. 2) so as to match the original point.

The warping yarns A which have passed through the closed reed 38 and the space setting reed 66 are hooked on heddle hooks formed on the warping drum 12.

In FIG. 9, reference numeral 214 stands for a left moving switch, and 216 represents a right moving switch, both of which are manually operated. Reference numeral 218 stands for an emergency stop switch.

CUT SHEDDING UP AND FRONT SHEDDING

Operation of the start switch 204 causes the warping drum 12 to rotate at the predetermined shedding speed. The advancing angle of the warping drum 12 will be read then. When the drum 12 arrives at the position for the cut shedding up preparation, the air cylinder 134 for the yarn pushing member is operated to have the warping yarns A pushed laterally (to the right in FIG. 1). When it arrives at the cut shedding up position, the warping drum 12 stops. Then the air cylinder 122 of the lease tape driving mechanism 94 is operated to advance the movable unit 98, so that the rubber roller 126 comes into contact with the lease tapes T for the cut shedding down. Next the motor 120 is driven to feed the lease tapes T to the extent equal to the band width of the warping yarns T. The air cylinder 122 is turned off, and the movable unit 98 retreats, followed by the release of the air cylinder 134 for the yarn pushing member. These operations cause the lease tapes T to pass over the warping yarns A.

Following the above-mentioned operations, the warping drum 12 is again rotated at the shedding speed, and reading of the advancing angle of the drum is started. When the drum 12 arrives at the position for the first front shed preparation, the air cylinder 70 is operated so as to have the guide roller 78 rotated to the shedding position. At the same time, the air cylinder 50 is operated, causing the rubber roll 52 and the yarn pushing shaft 48 to sandwich the warping yarns A, which are made tensive as predetermined. The motor 42 for moving up and down the closed reeds is operated so as to make lease as illustrated in FIG. 2.

Next the air cylinder 90 is operated to cause the lease rods 88 to enter into the lease. The succeeding operation of the air cylinder 82 makes the lease rods 88 move upward to keep the lease. The air cylinder 134 is operated to make the lower warping yarns moved laterally by the yarn pushing member 132. When the warping drum 12 reaches the first front shedding position and stops there, the air cylinder 122 of the lease tape driving mechanism 94 is operated, the movable unit 98 moves forward, the rubber roller 126 comes into contact with the lease tapes T for the first front shedding and the motor 120 is driven to feed the lease tapes T to the extent equal to the band width of the warping yarns A. After this, the air cylinder 122 is released, the movable unit 98 retreats, and the air cylinder 134 is released, so that the yarn pushing member 132 returns to its original position.

The warping drum 12 rotates again at the shedding speed. While the advancing angle of the drum 12 is being read, the air cylinder 82 is released to cause the lease rods 88 to move downwards, the air cylinder 90 is released to make the lease rods 88 move backwards, and the motor 42 for moving the closed reed 38 up and down is driven, so that the lease of the warping yarns A are closed.

When the warping drum 12 reaches the position for the second front shed preparation, the motor 42 is driven, so that lease opposite to the first front lease are formed on the warping yarns A. Then the air cylinder 90 is operated to have the lease rods 88 advanced into the lease. The operation of the air cylinder 82 makes the lease rods 88 go upwards, there-by keeping the lease. The air cylinder 134 is operated, the yarn pushing member 132 moves forward to push laterally the yarns under the lease. The warping drum 12 arrives at the second front lease position and stops there. The air cylinder 122 of the lease tape driving mechanism 94 is operated to have the movable unit 98 advanced. The rubber roller 126 comes into contact with the lease tapes T. Operation of the motor 120 causes the lease tapes T (for the second front shedding) to be fed according to the band width of the warping yarns A. After this, the air cylinder 122 is released, the movable unit 98 moves backward, and the air cylinder 134 is released to make the yarn pushing member 132 return to the original position.

The warping drum 12 is again rotated at the shedding speed, and the air cylinder 82 is released. The lease rods 88 move downward and leave from the lease following the release of the air cylinder 90. The forward rotation of the motor 42 causes the lease to be closed. Then the rodless cylinder 58 is operated to let the space deciding reed 66 move to the warping position. At the same time, the backing motor 188 is rotated to have the base plate 56 advanced. The release of the air cylinder 82 makes the guide roller 78 return to the warping position.

Then the warping drum 12 begins rotating at the warping speed, and the reed space setting member 26 starts feeding the warping yarns. The backing motor 188 rotates backward according to the amount of the fed warping yarns, so that the distance between the yarns on the warping drum and the guide roller 78 is always kept constant and the warping yarns A are wound around the warping drum 12 in tapered shape.

CUT SHEDDING UP AND BACK SHEDDING

When the predetermined length of the warping yarns are wound on the warping drum 12, the warping drum 12 changes its speed to the shedding speed, and passes over the drum original point and the drum angle reading position. Then the drum advancing angle is started to be read. When the warping drum 12 reaches the position for the cut shedding up preparation, the base plate 56 on the reed space setting member 26 is returned to the shedding position by the backing motor 188. The rodless cylinder 58 is operated to cause the space setting reed 66 to retreat to the shedding position. The reed space setting member 26 moves 20 mm in the warping direction (to the left in FIG. 1). The air cylinder 134 is operated, so that the warping yarns A are pushed laterally by the yarn pushing member 132.

When it reaches the cut shedding up position, the warping drum 12 stops rotating. The air cylinder 122 of the lease tape driving mechanism 94 is operated to advance the movable unit 98, which causes the rubber roller 126 to come into contact with the lease tapes T. Operation of the lease tape feeding motor 120 makes the lease tapes T be fed to the extent according to the band width of the warping yarns A. Then the air cylinder 122 is released to have the movable unit 98 moved backward. Release of the air cylinder 134 causes the yarn pushing member 132 to return to the original position.

The warping drum 12 again rotates at the shedding speed, and the drum advancing angle is started to be read. When the drum 12 arrives at the position for the first back shed preparation, the air cylinder 70 is operated to cause the guide roller 78 to rotate to the shedding position. The air cylinder 50 is operated so that the rubber roll 52 and the yarn pushing shaft 48 sandwich the warping yarns A so as to make them tensive as predetermined. The motor 42 for moving the closed reeds 38 is driven forward so that the warping yarns T are formed with lease. The air cylinder 90 is operated, and the lease rods 88 go into the lease and are raised by the air cylinder 82 so as to keep the lease. The air cylinder 134 is operated, the yarn pushing member 132 goes forward and pushes the yarns under the lease.

When it reaches the first back shedding position, the warping drum 12 stops rotating. The air cylinder 122 is operated in the lease tape driving mechanism 94, and the movable unit 98 of the mechanism moves forward so as to cause the rubber roller 126 to come into contact with the lease tapes T for the first back shedding. When the feeding motor 126 is driven, the lease tapes T are let off depending upon the band width of the warping yarns A. After this, the air cylinder 122 is released, the movable unit 98 returns to the original position, and the air cylinder 134 is released, so that the yarn pushing member 132 returns to the original position.

The warping drum 12 again rotates at the shedding speed. While the advancing angle of the drum 12 is being read, the air cylinder 82 is released to cause the lease rods 88 to move downward. The air cylinder 90 is released to let the lease rods 82 back out of the first back sheds, and the motor 42 for the closed reeds 38 is driven backward, thereby closing the first back sheds.

When the warping drum 12 reaches the position for preparing the second back sheds, the motor 42 is driven backward so as to cause the closed reeds 38 to form sheds opposite to the first back sheds. Then the air cylinder 90 is operated, letting the lease rods 88 go into the second back sheds. The air cylinder 82 is operated, and the lease rods 88 are moved upward to make the lease. Following the operation of the air cylinder 134, the yarn pushing member 132 laterally pushes the yarns under the lease.

When it arrives at the second back shedding position, the warping drum 12 stops rotating. The air cylinder 122 is operated to make the movable unit 98 go forward in the lease tape driving mechanism 94, so that the rubber roller 126 comes into contact with the lease tapes T for the second back sheds. Then the lease tapes T are let off by the motor 120 to the extent according to the band with of the warping yarns A. After this, the air cylinder 122 is released to make the movable unit 98 go backward, and the air cylinder 134 is also released, thereby returning the yarn pushing member 132 to the original position.

When the warping drum 12 resumes rotating at the shedding speed, the air cylinder 82 is released. The lease rods 88 move downward and leave from the second back sheds following the release of the air cylinder 90. The motor 42 is driven forwardly so as to close the second back sheds. The air cylinder 70 is released to cause the guide roller 78 to return to the warping position. When the warping length counting signal is issued and when the warping drum 12 reaches the original point, the warping drum 12 stops rotating.

The motor 28 is driven, and the reed space setting member 26 moves to the second band starting position, so that the warping procedure for the first band is completed. Then the warping drum 12 starts rotating at the shedding speed, so that the second band is initiated. The operation same as that for the first band is repeated for the desired times.

When the inking is performed at the end of the first band, the warping drum stops rotating at the inking length. Then the inking is performed by a conventional method. An inking length counter reset switch 206 is depressed to reset the count value, and the start switch 204 is also depressed. After this the warping drum 12 starts rotating, and stops at the next inking position. This process will be repeated.

When the final band is finished, the word "END" is given on the display 156 of the program setting unit 150.

Firstly the yarns for the final band are cut, the auto/-manual switch 208 is pushed to the manual position, and the start switch 204 is pushed. Then the warping drum 12 starts rotating at a low speed. When the drum 12 arrives at the lease tape position, the stop switch 210 is depressed to stop the drum 12. When the lease tape switch 212 is depressed, the air cylinder 122 is operated and the movable unit 98 moves forward in the lease tape driving mechanism 94, so that gears 130 of the movable unit 98 engage with a gear 106 of the reel 100. Then the lease cords are tied to the holes 110 of the heddle hooks 112 disposed at the end of the reed tapes T. When a switch for retreating the tape (not shown) is pushed, a motor 118 is driven so as to rewind the reed tape T to the initial position. After this the lease cords are inserted in place of the reed tapes T. Redepression of the lease tape switch 212 causes the air cylinder 122 to release and causes the movable unit 98 to retreat. The respective lease tapes T are retreated and the lease cords are inserted as described above.

The warping/reeling switch (not shown) is depressed to the reeling position, warp beams are placed on the reeling unit, and the upper yarns of the lease cords for the cut shedding up are gripped to be cut. When all the warping yarns are cut, the end of the yarns are placed on the warp beams. When the drum brake is adjusted to rotate the warp beams, the yarns on the warping drum 12 are vertically reeled on the warp beams.

The above description is related to the sectional warping machine. However this invention is not limited to the foregoing embodiment. The automatic shedding mechanism according to this invention is also applicable to a warping machine by changing the widths of the closed reed and the space deciding reed.

What is claimed is:

1. An automatic shedding mechanism comprising:

(a) a warping drum which is rotatably disposed on a bearing via a drum shaft and is rotated by driving means including an electronically controlled motor;

(b) a plurality of lease tapes which are conducted onto the surface of said warping drum via a lease tape guide and are moved between lease formed by warping yarns;

(c) a reel which is disposed on a side of said warping drum and includes means for reeling said lease tapes; and (d) a movable unit which is moved back and forth by said electronically controlled driving means so as to come into contact with and out of contact from said lease tapes and said means for reeling.

2. An automatic shedding mechanism according to claim 1, wherein the number of lease tapes depends upon the number of necessary lease.

3. An automatic shedding mechanism according to claim 1 or 2, wherein said lease tapes are flexible in the lengthwise direction and are difficult to bend in the widthwise direction.

4. An automatic shedding mechanism according to claim 3, wherein said lease tapes are steel tapes having a thickness of 0.3 mm or less and a width of 50 mm or less.

5. An automatic shedding mechanism according to claims 1 or 2, wherein said lease tapes have at their ends hooks with holes for hooking lease cords.

6. An electronically controlled sectional warping machine in which a warping process is performed by dividing all the warping yarns for fabric into a certain number of bands, by passing warping yarns supplied from a creel for one band through a closed reed and a space deciding reed, by reeling warping yarns around a warping drum at the necessary density and to the necessary length, so that warping is done for the desired number of warping yarns and to the desired warping width; said electronically controlled sectional warping machine comprising:

(a) a warping drum which stops rotating when it reaches the predetermined position;

(b) closed reeds for forming lease by dividing warping yarns from said creel into upper and lower yarns;

(c) a space deciding reed moved back and forth by a driving mechanism so as to decide the spacing of the warping yarns;

(d) lease rods going into lease formed by said closed reeds and moving upward so as to keep the lease;

(e) a plurality of lease tapes which are let off to the surface of said warping drum via a lease tape guide so as to maintain the lease while going through the lease;

(f) a reel which is disposed on a side of said warping drum so as to take in said lease tapes and includes means for reeling said lease tapes; and (g) a movable unit which is moved back and forth by the electronically controlled driving means so as to let off and rewinding said lease tapes.

* * * * *